United States Patent [19]

Chakravorty et al.

[11] Patent Number: 4,988,413

[45] Date of Patent: Jan. 29, 1991

[54] REDUCING PLATING ANOMALIES IN ELECTROPLATED FINE GEOMETRY CONDUCTIVE FEATURES

[75] Inventors: Kishore K. Chakravorty, Issaquah; Lane S. Lathrop, Renton, both of Wash.

[73] Assignee: The Boeing Company, Seattle, Wash.

[21] Appl. No.: 312,890

[22] Filed: Feb. 17, 1989

[51] Int. Cl.[5] ..... C25D 5/02

[52] U.S. Cl. ..... 204/15; 204/32.1

[58] Field of Search ..... 204/15, 32.1

[56] References Cited

PUBLICATIONS

IBM Technical Disclosure Bulletin, Sep. 1973, pp. 1035, 1036.

Cech et al., *Photoimageable Polyimide: A Dielectric Material for High Aspect Ratio Structures,* reprint from the "Proceedings of SPIE–The International Society for Optical Engineering–Advances in Resist Technology and Processing III," Mar. 1986, Santa Clara, Calif., SPIE vol. 631, pp. 202–205, 1986.

Chakravorty et al., *Photosensitive Polyimide as a Dielectric in High Density Thin Film Copper–Polyimide Interconnect Structures,* Abstract of Paper presented at the Electrochemical Society Conference, May 1988, Atlanta, Ga., published Mar. 23, 1988.

Endo et al., *Material and Processing Technologies of Polyimide for Advanced Electronic Devices,* J. Electrochem. Soc.: Solid-State Science and Technology, vol. 134, No. 10, Oct. 1987.

Moriya et al., *High-Density Multilayer Interconnection with Photo-Sensitive Polyimide Dielectric and Electroplating Conductor,* proceedings 34th Electronic Component Conference IEEE, pp. 82–87, 1984.

Pfeifer et al., *Direct Photoimaging of Fully Imidized Solvent-Soluble Polimides,* presented at Second International Conference on Polyimides, Mid-Hudson Section SPE, Oct. 30–Nov. 1, 1985, Ellenville, N.Y.

Rubner et al., *A Photopolymer–The Direct Way to Polyimide Patterns,* Photographic Science and Engineering, vol. 23, No. 5, Sep./Oct. 1979, pp. 303–309.

*Primary Examiner*—T. M. Tufariello

*Attorney, Agent, or Firm*—Christensen, O'Connor, Johnson & Kindness

[57] ABSTRACT

An etching process provides a surface of a seed layer substantially free of surface anomalies that could effect the morphology of conductive features that are electroplated onto the surface of the seed layer between dielectric features photolithographically patterned in a dielectric composition. The etching serves to remove at least several monolayers from the upper surface of the seed layer. The conductive features electroplated thereon exhibit excellent morphology and edges that are substantially free of surface roughness and nodular film growth.

28 Claims, 3 Drawing Sheets

REDUCING PLATING ANOMALIES IN ELECTROPLATED FINE GEOMETRY CONDUCTIVE FEATURES

BACKGROUND OF THE INVENTION

The present invention relates to a process for electroplating fine geometry electrically conductive features between dielectric features photolithographically patterned in a layer of a fully-imidized photosensitive polyimide dielectric composition, particularly to a method for reducing the formation of distortions in the electrically conductive features formed by the electroplating step.

Continual advancements in the speed and integration level of integrated circuits used in high performance systems have created a demand for the development of an interconnect technology that offers a high wiring density, good electrical characteristics for the propagation of high speed signals, and good thermal performance. Multi-layer interconnection schemes with fine line conductors and associated ground planes have been proposed for applications in high performance systems. Fine geometry copper conductor lines defined in a photolithographically patterned layer of a low-dielectric constant polymer, such as a polyimide, have emerged as a versatile packaging approach for the conductive interconnection lines between densely packed integrated circuit chips in high performance systems.

In general, fine geometry electrically conductive features, such as conductor lines, can be produced by the following steps: (1) depositing a thin layer of a metallic seed layer on a dielectric substrate, (2) etching the seed layer to form fine geometry lines that serve as the electroplating base for the conductor lines, (3) spin coating a layer of a photosensitive dielectric composition over the dielectric substrate and etched seed layer, (4) photolithographically patterning the layer of the dielectric composition to form fine geometry dielectric features, the seed layer being uncovered between these dielectric features, and (5) electroplating an electrically conductive material between the patterned dielectric features onto the metallic seed layer to form electrically conductive features.

The formation of distortions in the electrically conductive features that are electroplated between the patterned dielectric features is undesirable because of the nonreproducible electrical characteristics these distortions introduce into the conductive features. For example, when the surfaces of the conductive features are rough, the electrical resistance is unpredictable. Also, nodular film growth on the surface of the conductive features increases the risk of electrical short circuits between adjacent conductive features. As the speed and integration level of integrated circuits in high performance systems increases, there is an increasing need to reduce, and preferably prevent, the formation of distortions in the densely packed electrically conductive features that interconnect the integrated circuits.

SUMMARY OF THE INVENTION

The present invention is a method for reducing the formation of distortions in electrically conductive features that are formed by electroplating conductive materials onto a surface of a seed layer. The electrically conductive features formed by a process carried out in accordance with the present invention are characterized by excellent morphology and well-defined edges free of surface roughness and nodular film growth. The electrically conductive features can form electrical interconnect lines in modules containing multiple integrated circuits.

A method carried out in accordance with the present invention returns the surface of the seed layer to a state satisfactory for providing conductive features having excellent morphology and well-defined edges free of surface roughness and nodular film growth when an electrically conductive material is electroplated thereon. The method involves removing at least several monolayers of the seed layer from the surface to be electroplated over. In certain applications where a layer of an adhesion promoting composition is applied to the surface of the seed layer, the method involves removing the layer of the adhesion promoting composition and at least several monolayers of the seed layer from the surface to be electroplated over. The term "monolayer," as used herein, refers to a layer of the seed layer that is one molecule thick. Electrically conductive features electroplated onto a surface of a seed layer provided in accordance with the present invention have excellent morphology and less surface roughness when compared to conductive features electroplated onto a surface of a seed layer that has not had at least several monolayers of the seed layer removed from the surface.

A method carried out in accordance with the present invention can be used in a process for forming conductive features by electroplating conductive materials onto a seed layer having fine geometry features that have had an adhesion promoting composition applied thereto. The conductive features are well defined and are free of surface distortions and anomalies that result from changes in the surface of the seed layer before the conductive material is electroplated thereon. First, a seed layer is formed on a dielectric substrate, an adhesion promoting composition is then applied onto the seed layer and dielectric substrate. A dielectric composition is then applied over the coated seed layer and dielectric substrate. The adhesion promoting composition will promote the adhesion of the dielectric composition with the seed layer and dielectric substrate. After the dielectric composition had been applied over the seed layer, dielectric substrate, and adhesion promoting composition, the dielectric features are formed by photolithographically patterning the dielectric composition and removing at least a portion of the dielectric composition so that the surface of the seed layer to be electroplated over is uncovered. The surface of the seed layer is prepared for electroplating the conductive material thereon by removing the adhesion promoting composition and at least several monolayers of the seed layer from the surface. After at least several monolayers of the seed layer have been removed from the surface, a conductive material can be electroplated onto the surface to form the conductive features.

Other objects, features, and advantages of the present invention will be readily apparent from the following description of certain preferred embodiments thereof, taken in conjunction with the accompanying drawings. It is understood that variations and modifications may be effected without departing from the spirit and scope or the novel concepts of the disclosure.

BRIEF DISCRIPTION OF THE DRAWINGS

DETAILED DESCRIPTION OF THE INVENTION

Figure 1:
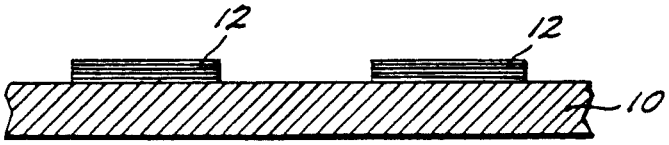
FIGS. 1–7 are schematic, cross-sectional views representing the sequence of an electroplating process carried out in accordance with the present invention.

Fully-imidized photosensitive polyimide dielectric compositions offer significant advantages over their polyamic acid precursor-based photosensitized counterparts that must be chemically or thermally imidized after they are applied onto a substrate. However, the fully-imidized polyimide dielectric compositions exhibit a poor adhesion to silicon dioxide, aluminum, copper, silicon, and other surfaces commonly used in the microelectronics industry. The poor adhesion characteristic necessitates the use of an adhesion promoting composition to improve the adhesion of the fully-imidized polyimide dielectric composition with the underlying surfaces. For example, an adhesion promoting composition can be applied to a dielectric silicon wafer including patterned features of a seed layer prior to spin coating a layer of the fully-imidized polyimide thereon. The adhesion promoting composition effectively interacts with the underlying surfaces and the fully-imidized polyimide dielectric composition insuring good adhesion between the two.

When attempting to photopattern features into the fully-imidized photosensitive polyimide dielectric composition, having vertical thicknesses on the order of about 5 microns to about 15 microns and widths of about 6 microns and larger, it has been found that by applying a sacrificial layer of metal comprising titanium, chromium or a similar metal to the surface of the seed layer before applying the adhesion promoting composition, the adhesion of the dielectric composition to the underlying surfaces can be improved compared to the adhesion achieved when only the adhesion promoting composition is applied to the seed layer. Alternatively, the sacrificial layer may also include a dielectric composition such as a silicon dioxide, which like the titanium or chromium, improves the adhesion between the polyimide based dielectric composition and the underlying surfaces. However, attempts to electroplate conductive materials directly onto the seed layer having the adhesion promoting composition or the sacrificial layer of metal applied thereto, result in conductive features that have rough surfaces and nodular film growth. Even features that are electroplated onto a surface of a seed layer that has had the adhesion promoter and/or the sacrificial layer of metal removed suffer from surface roughness and nodular film growth. A method carried out in accordance with one aspect of the present invention wherein at least several monolayers of the seed layer is removed, provides a surface of the seed layer that is satisfactory for providing conductive features having excellent morphology and well-defined edges free of surface roughness and nodular film growth when an electrically conductive material is electroplated thereon. As used herein, the phase "seed layer" refers to the initial metallic layer that is formed on the substrate, and does not include the sacrificial layer of metal comprising titanium, chromium or other similar metal, or the dielectric sacrificial layer such as silicon dioxide, that can be deposited on top of the "seed layer".

It has been found that in applications involving the electroplating of fine geometry conductive features between dielectric features photolithographically patterned in a layer of a fully-imidized polyimide dielectric composition, the presence of an adhesion promoting composition directly on the surface of the seed layer to be electroplated over adversely affects the results of the electroplating process. For example, when a copper-containing conductive material is electroplated onto a surface of a gold-containing seed layer, the presence of the adhesion promoting composition on the surface of the gold-containing seed layer has been found to result in nonreproducible characteristics in terms of the surface morphology of the electroplated conductive feature. The conductive feature also exhibits a poor adhesion with the seed layer and adhesion promoting composition that allows the conductive feature to be easily peeled off of the seed layer. It has also been found that even after the adhesion promoting composition is removed from the surface of the seed layer, conductive features that are thereafter electroplated onto the surface of the seed layer still have surfaces that are rough and suffer from nodular film growth.

The present invention is based upon the discovery that the poor electroplating characteristics described above can be substantially reduced by removing at least several monolayers of the seed layer from the surface to be electroplated over, prior to electroplating. If the sacrificial layer or the adhesion promoting composition has been applied to the surface of the seed layer, it must be removed prior to or in conjunction with removing at least several monolayers of the seed layer from the surface. The term "monolayer," as described above, refers to a layer of the seed layer that is one molecule thick; several monolayers refer to two or more monolayers that generally have a total thickness of at least about 10 angstroms.

Figure 2:
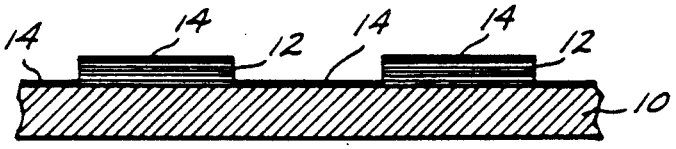
Figure 3:
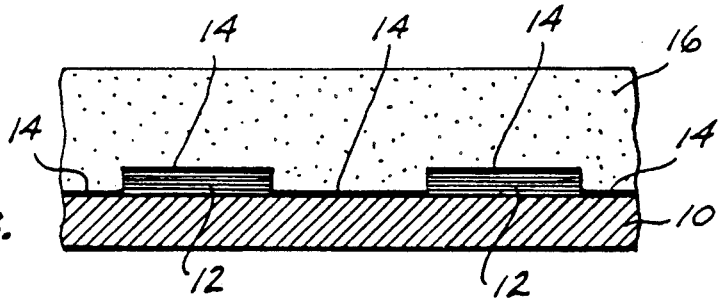
Figure 4:
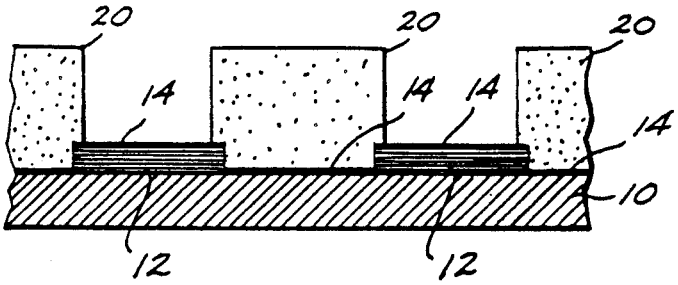
Figure 5:
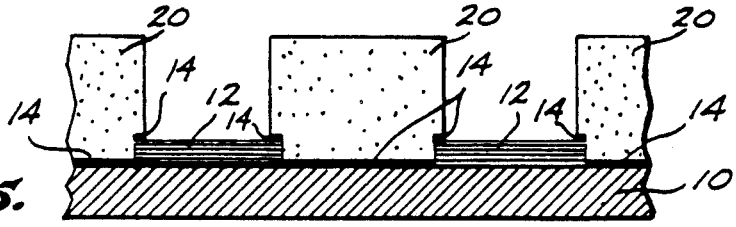
Figure 6:
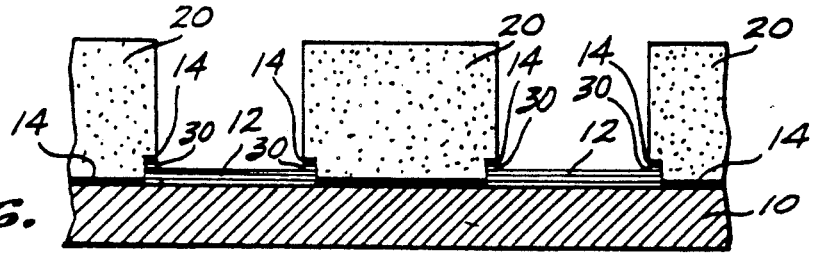
Figure 7:
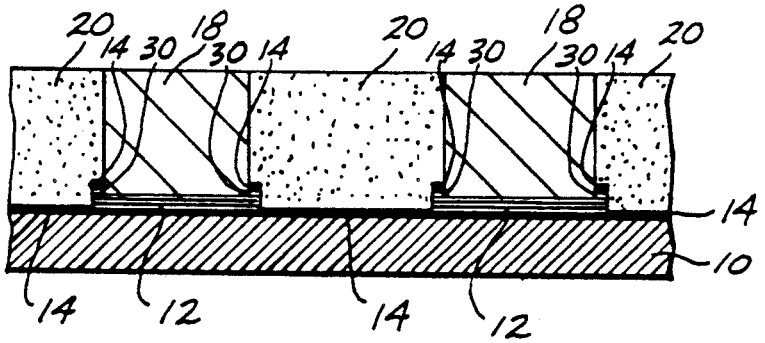

Referring to FIGS. 1–7, a preferred embodiment of an electroplating process involves forming a fine geometry seed layer 12 on top of a dielectric substrate 10. The substrate 10 and seed layer 12 are then coated with a thin layer 14 of an adhesion promoting composition as shown in FIG. 2. Although the adhesion promoting composition is described as being applied as a layer 14, it should be understood that the layer 14 may be a continuous layer or a discontinuous layer. In FIG. 3, a layer 16 of a dielectric composition is coated over the layer 14 of the adhesion promoting composition that coats the substrate 10 and seed layer 12. Referring to FIG. 4, the layer 16 of the dielectric composition is then photolithographically patterned to form dielectric features 20 and uncover portions of the seed layer 12 that are coated with the adhesion promoting composition. The uncovered portions define the surfaces of the seed layer that will eventually be electroplated over. When photolithographically patterning the dielectric composition, a positive overlap of the patterned dielectric features 20 over the seed layer is maintained such that the width of the uncovered seed layer is less than the patterned width of the seed layer. In this configuration, the edges of the dielectric features 20 sit on the edges of the seed layer 12. This configuration eliminates possibilities of any voids or gaps forming between the dielectric features 20 and the seed layer 12 after the trenches between the patterned dielectric features 20 are filled by electroplating a metal on a surface of the seed layer. The positive overlap also provides adequate tolerances to accommodate less than exact alignment of the dielectric features 20 over the seed layer 12. In FIG. 5, as described in more detail below, the layer 14 of adhesion promoting composition coating the uncovered portions of seed layer 12 is removed therefrom, without removing the adhesion promoting composition that is beneath the dielectric features 20. In FIG. 6, as also described in more detail below, at least several monolayers of the seed layer 12 are removed from the upper surface of the seed layer 12, to provide an upper surface of the seed layer 12 that is satisfactory for electroplating conductive materials thereon to form conductive features that have excellent morphology and little or no surface roughness or nodular film growth. As in FIG. 5, removal of at least several monolayers of the seed layer in FIG. 6 does not remove the adhesion promoting composition beneath the dielectric features 20, nor does it remove a portion 30 of the seed layer that is beneath the positive overlap between the dielectric feature 20 and the seed layer 12. In FIG. 7, a conductive material has been electroplated onto the uncovered surface of the seed layer 12 in FIG. 6 to form conductive features 18. The conductive features 18 will have excellent morphology and clearly defined edges free of surface roughness and nodular film growth.

Referring back to FIG. 4, removal of the layer 14 of the adhesion promoting composition from the uncovered surface of the seed layer 12 can be accomplished by any method that effectively removes the adhesion promoting composition on top of the surface of the seed layer 12 to be electroplated over without removing the adhesion promoting composition that is beneath the dielectric features 20. One method of selectively removing the layer 14 of the adhesion promoting composition uses the known technique of plasma assisted etching. Plasma assisted etching involves contacting the uncovered layer 14 of the adhesion promoting composition with an etching gas, for example, carbon tetrafluoride plus oxygen plasma, for a short time, preferably about 2–4 minutes. The purpose of the plasma assisted etching is to etch off the adhesion promoting composition from the uncovered surface of the seed layer 12. The plasma assisted etching step also serves to remove any unwanted residue of the layer 16 of the polyimide dielectric composition left from the photolithographic patterning step. When using carbon tetrafluoride plus oxygen plasma as the etching gas, equal flow rates of about 50 cubic centimeters per minute at a total pressure of 250 millitorr and a plasma power of about 250 watts is suitable, although other conditions may be equally effective. For instance, the flow rate of the oxygen plasma can be reduced to about 12.5 cubic centimeters per minute in order to reduce the chemical modification of the seed layer by the active species in the plasma. The plasma assisted etching is a preferred method of selectively removing the layer 14 of the adhesion promoting composition from the uncovered top surface of the seed layer 12 due to its unidirectional etching characteristic which prevents the plasma etching step from removing the adhesion promoting composition beneath the photolithographically patterned dielectric features 20. Naturally, depending upon the particular adhesion promoting composition chosen, the active species in the etching gas must be appropriately chosen to be selective for the particular adhesion promoting composition. When using an adhesion promoting composition containing an amino-silane described in more detail below, it has been found that the carbon tetrafluoride plus oxygen plasma etching gas described above effectively removes the layer 14 of the adhesion promoting composition from the surface of the seed layer 12 that is to be electoplated over.

Referring again to FIG. 6, after the layer 14 of the adhesion promoting composition has been removed from the uncovered upper surface of the seed layer 12, it has been found that in order to electroplate the conductive material onto the surface of the seed layer 12 and produce conductive features 18 having excellent morphology and well defined edges free of surface roughness and nodular film growth, it is necessary to remove at least several monolayers from the uncovered upper surface of the seed layer 12. The removal of at least several monolayers from the upper surface of the seed layer 12 provides a surface of the seed layer that is substantially free of alternations and anomalies that, if not removed, would result in electroplated conductive features 18 having less than a smooth, well-defined surface morphology. The layer comprising the monolayers that are removed from the upper surface of the seed layer 12 is a layer that has been effectively altered by interacting with the adhesion promoting composition and/or the active species in the plasma etching gas. The process of the present invention provides a surface of the seed layer 12, substantially free of chemical complexes, residues, surface distortions, surface alterations, or anomalies that would otherwise affect the surface morphology of conductive features electoplated thereon.

Removal of the monolayers of the seed layers is achieved by an etching process that does not adversely affect the dielectric features 20 or the layer 14 of the adhesion promoting composition underlying the dielectric features 20. The particular method chosen to etch the upper surface of the seed layer 12 must be conducted under conditions that make the etching step selective for the materials making up the upper surface of the seed layer 12 to be electroplated over. A wet etching process is an example of an etching process that can effectively remove at least several monolayers of the seed layer 12 from the upper surface of the seed layer 12 without adversely affecting the surrounding features. Wet etching of a gold-containing seed layer 12 can be accomplished by contacting the surface of the seed layer for about 10 seconds under sonication with an etching solution consisting of a mixture of concentrated (12N) nitric acid and hydrochloric acid in a ratio of 3:1, diluted two and one half times to three and one half times in deionized water. The temperature for the wet etching step is preferably between about 30° and 40° C. Etching under these conditions removes about 40–100 Å from the top of the uncovered portions of the gold-containing seed layer 12. Although a wet etching process is normally isotropic and therefore is capable of removing some of the adhesion promoting composition that is underneath the dielectric features 20, the use of etching solutions that do not contain fluorine-based acids will insure that amino-silane based adhesion promoting compositions will be substantially unaffected. In order to provide a satisfactory upper surface of the seed layer for electroplating in the context of the present invention, at least several monolayers of the seed layer must be removed from the top surface of the seed layer 12. Depending on the particular composition of the seed layer 12, the total thickness of the monolayers that are removed by the wet etching step should be at least 10 Å thick, preferably, the total thickness of the monolayers is at least about 30 Å and, most perferably, when the seed layer comprises a gold-containing composition the total thickness of the monolayers is at least about 40 Å. Other etching processes may be used to remove at least several monolayers of the seed layer so long as the etching process provides a surface that when electroplated over results in features that have excellent morphology, well-defined edges, and are free of nodular film growth.

Figure 9:
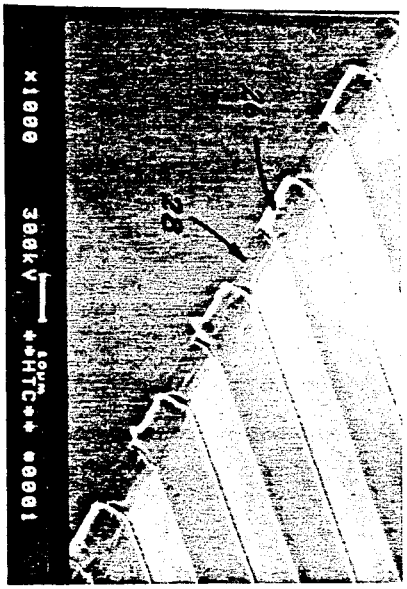
FIG. 9 is a photomicrograph of a cross section of a series of fine geometry conductive featues formed by an electroplating process carried out in accordance with the present invention.
Figure 8:
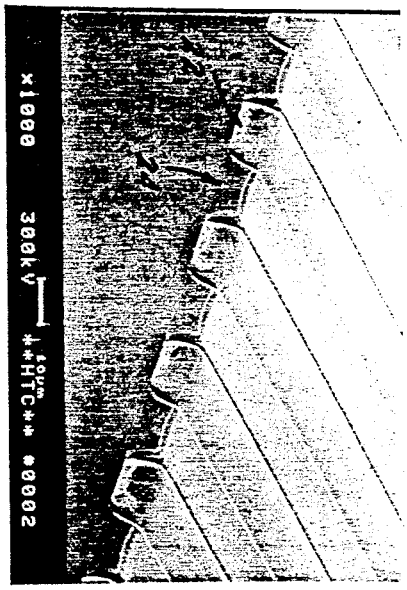
FIG. 8 is a photomicrograph of a cross section of a series of fine geometry conductive features formed by an electroplating process carried out in accordance with the invention.

After both the plasma etching step and the wet etching step have been completed, the conductive material can be electroplated onto the surface of the seed layer by conventional means such as connecting the seed layer to a voltage source and immersing the substrate and the seed layer in an electroplating bath. The conductive materials that are electroplated onto the surface of the seed layer between the patterned dielectric features include gold or copper or any other electrically conductive material commonly used in the microelectronics industry. Referring to FIG. 8, conductive features in the form of fine geometry conductors lines 14 microns wide and 6 microns thick indicated by reference numeral 22 were plated onto a surface of a seed layer that had been coated with an adhesion promoting composition and treated in accordance with the present invention. The conductive features 22 are electroplated between dielectric features 11 microns wide and 6 microns thick represented by reference numeral 24. Referring to FIG. 9, conductive features in the form of fine geometry conductor lines 14 microns wide and 6 microns thick, indicated by reference numeral 26, were plated onto a surface of a seed layer that had been coated with a sacrificial titanium layer and an adhesion promoting composition and then treated in accordance with the present invention. As in FIG. 8, the conductive features 26 are electroplated between dielectric features about 11 microns wide and 6 microns thick, represented by reference numeral 28. The conductive features in both FIGS. 8 and 9 have excellent morphology and edges that are free of surface roughness and nodular film growth.

Although a preferred embodiment had been described above,. wherein an adhesion promoting composition is applied directly to a surface of the seed layer, when photopatterning features into the dielectric composition, the adhesion between the dielectric composition and the underlying dielectric and conductive features can be increased by providing a sacrificial layer of metal comprising titanium, chromium or a similar metal, or a dielectric sacrificial layer of silicon dioxide between the seed layer and the adhesion promoting composition. When the sacrifical layer is used, the adhesion promoting composition can be removed as described above by plasma etching. In addition, an amino-silane adhesion promoting composition and a sacrificial layer comprising titanium or silicon dioxide can be removed in a single step by plasma etching under slightly harsher conditions than those required to remove the adhesion promoting composition alone. For example, plasma etching with an etching gas comprising about 50 cubic centimeters per minute carbon tetrafluoride plus about 5 to 15 cubic centimeters per minute of oxygen plasma, for about 4–6 minutes, under a total pressure of about 250 millitorr and a plasma power of about 250 watts is suitable, although other conditions may be equally effective. Other methods of removing the sacrificial layer of titanium or silicon dioxide may also be equally effective so long as they do not remove the adhesion promoting composition beneath the dielectric features and do not attack or degrade the dielectric features themselves. Once the adhesion promoting composition and the sacrificial layer is removed, at least several monolayers of the seed layer can be removed by wet etching as described above. If chromium is used as a metal in the sacrificial layer, an etching solution containing perchloric acid and cerric ammonium nitrate, such as a chromium photomask etchant available from Cyantek Corporation under the designation CR-7 is preferred to remove the sacrifical layer, although other methods may be satisfactory, so long as they do not remove the adhesion promoting composition beneath the features patterned in the dielectric composition or the dielectric features themselves. As above, once the adhesion promoting composition and the sacrificial layer comprising chromium are removed, at least several monolayers of the seed layer can be removed as described above.

Referring back to FIG. 1, the seed layer 12 that is to be electroplated with the conductive materials in an electroplating process carried out in accordance with the present invention can be made from gold, copper, or palladium using known metallization and photoresist techniques for depositing and etching metallic seed layers on a dielectric substrate. The seed layer is preferably provided on a dielectric substrate such as a silicon wafer or the like commonly used in the microelectronics industry. The present invention can be applied to a seed layer of any dimension; however, the benefits of the present invention are most evident when electroplating conductive materials onto a fine geometry seed layer having dimensions similar to those described above.

Although not shown, the sacrificial layer of titanium, chromium, or a similar metal can be applied to a surface of the seed layer by conventional techniques, such as E-beam deposition. The sacrificial layer of silicon dioxide or a similar dielectric composition can be deposited by a plasma process such as sputtering or checmical vapor deposition. The sacrificial layer is preferably deposited onto the surface of the seed layer before the seed layer has been patterned, for example, by a photoresist technique. This allows the seed layer and the sacrificial layer to be patterned simultaneously. The sacrificial layer is preferably about 500 angstroms thick, although thicker or thinner layers may be equally effective for promoting the adhesion of the polyimide with the seed layer and the dielectric substrate. Titanium, chromium, and silicon dioxide are given as examples of metals and dielectrics that can be used as the sacrificial layer. Other metals or dielectrics in combination with the adhesion promoting composition can be used, so long as they enhance the adhesion of the polyimide to the underlying features when compared to the degree of adhesion observed when only the adhesion promoter is applied between the polyimide and the underlying features. It is preferred that the metal chosen for the sacrificial layer should be selectively etchable over the metal of the seed layer.

The adhesion promoting compositions useful in the present invention serve to promote the adhesion between the dielectric composition and the substrate onto which the dielectric composition is being coated. This substrate includes dielectric materials as well as conductive materials. An example of an adhesion promoting composition is a substituted amino-silane that can be represented by the general formula:

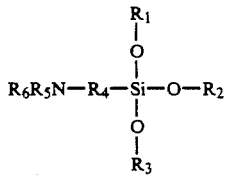

wherein $R_1$, $R_2$, $R_3$, $R_4$, $R_5$, and $R_6$ can be hydrogen or an organic radical, such as alkyl radicals and the like. The above formula is exemplary of the types of adhesion promoting compositions and amino-silanes that are useful in the context of the present invention. When using a fully-imidized polyimide dielectric composition and a silicon wafer as the dielectric substrate, adhesion promoting compositions comprising a substituted amino-silane such as those marketed by Ciba-Geigy Corp. as QZ 3289 are useful. Other amino-silane containing adhesion promoting compositions are available from Hitachi Chemical Co. and E. I. dupont de Nemours and Co. In order to effectively promote the adhesion between the dielectric composition and the dielectric substrate or the seed layer, the adhesion promoting composition should be coated onto the substrate and the seed layer in a thickness ranging between about 20–50Å by spin coating a dilute solution of the adhesion promoting composition. The adhesion promoting composition available from Ciba-Geigy Corp. described above can be diluted with an organic solvent, for example an ethanol/water containing solvent, available from Ciba-Geigy Corp. and designated as QZ 3290 .

The fully-imidized polyimides used as a dielectric composition as referred to above are also available from Ciba-Geigy Corp. under the trade name PROBIMIDE TM 400 Series. These polyimides making up the dielectric compositions are commercially available in a fully-imidized form and are inherently photosensitive. This is in contrast to other photosensitive polyimide precursor dielectric compositions that are applied as polyimide precursors comprising a photosensitive polyamic acid derivative that contains photosensitive functional groups, such as photosensitive esters, that are thermally imidized after being applied and photopatterned. The photosensitive ester groups volatilize during the course of the post-application/post-patterning imidization step. The fully-imidized polyimide can be synthesized by reacting benzophenone 3,3',4,4'-tetracarboxylic dianhydride (BTDA) with an aromatic diamine that carries orthoaliaphatic substituents and then chemically or thermally imidizing the reaction product. Another method of synthesizing the fully-imidized polyimides involves reacting the BTDA with diissocyanates.

The polyimide dielectric composition can be coated over the substrate and seed layer by spsin coating techniques. Such techniques allow layers of the fully-imidized polyimide dielectric composition having a vertical thickness between about 30 and 50 microns to be evenly and uniformly coated onto the substrate and seed layer. The coated polyimide film is then baked at a temperature of about 125° for about 5 minutes on a hot plate followed by about 30 minutes in a convection oven at 110° C. The baked layer of fully-imidized polyimide can then be photolithographically paterned by exposing it to ultraviolet (UV) radiation through a mask, followed by baking in an oven to a temperature of about 250° C. for about 90 minutes to drive off solvent, thus providing photolithographically patterned features between about 5 and 15 microns high. The photolithographic patterning step will uncover a portion of the seed layer coated with the adhesion promoting composition that is to be electroplated with the conductive material. After the seed layer coated with the adhesion promoting composition is uncovered, the adhesion promoting composition and at least several monolayers of the seed layer can be removed by the plasma etching and wet etching sequence described above.

The process carried out in accordance with the present invention reduces or eliminates the formation of surface anomalies when fine geometry conductive features are electroplated onto a surface of a metallic seed layer that has been covered with a substituted amino-silane or silimar type of adhesion promoting composition or a sacrificial layer of metal or dielectric alone or preferably in combination with an adhesion promoting composition. In a preferred embodiment, the process provides a surface of the seed layer that is substantially free of chemical complexes, residues, surface distortions or anomalies using a combination of a plasma etching step and a wet etching step. The conductive features formed by an electroplating process employing the etching steps in accordance with the present invention are characterized by excellent surface morphology and well-defined edges free of surface roughness and nodular film growth.

The present invention has been described in relation to a preferred embodiment, including the preferred applications and parameters. One of ordinary skill, after reading the foregoing specification will be able to effect various changes, substitutions of equivalents, and other alterations without departing from the broad concept disclosed herein. For example, although a preferred embodiment of the present invention has been described in relation to a two-step etching process in order to provide a substantially distortion-free upper surface of the seed layer, it is possible that other methods, using only one step or more than two steps will also provide a satisfactory surface of the seed layer in the context of the present invention. It is therefore intended that the scope of Letters Patent granted herein will be limited only by the definition contained in the appended claims and equivalents thereof.

The embodiments of the invention in which an exclusive property or privilege is claimed are defined as follows:

1. A method for reducing the formation of distortions in a conductive feature to be electroplated onto a surface of a seed layer, the method comprising the steps of:
   (a) plasma etching said surface of said seed layer to remove adhesion promoting composition applied to said surface of said seed layer;
   (b) removing at least several monolayers of said seed layer from said surface; and
   (c) electroplating said conductive feature onto said surface.

2. The method of claim 1, wherein step (b) further comprises:
   wet etching said surface of said seed layer to remove at least several monolayers from said surface of said seed layer.

3. The method of claim 2, wherein said seed layer comprises gold.

4. The method of claim 2, wherein said conductive feature comprises copper.

5. The method of claim 2, wherein at least about 30 angstroms of said seed layer is removed from said surface.

6. The method of claim 2, wherein said seed layer is supported on a dielectric substrate.

7. The method of claim 1, wherein said plasma etching is selective for said adhesion promoting composition.

8. The method of claim 2, wherein said wet etching step is selective for said seed layer.

9. The method of claim 2, wherein said plasma etching uses an active component, said active component chemically interacting with a portion of said seed layer, said wet etching step removing said portion of said seed layer that has chemically interacted with said active component.

10. The method of claim 6, wherein said surface of said seed layer is positioned between dielectric features photolithographically patterned in a dielectric composition, said adhesion promoting composition serving to promote the adhesion of said dielectric composition with said dielectric substrate, said adhesion promoting composition also serving to promote the adhesion of said seed layer with portions of said photolithographically patterned dielectric features that overlap said seed layer.

11. The method of claim 10, wherein said dielectric composition comprises a polyimide that is fully imidized prior to being photolithographically patterned.

12. The method of claim 10, wherein step (a) removes said adhesion promoting composition from said surface of said seed layer without removing said adhesion promoting composition between said dielectric substrate and said dielectric features and said adhesion promoting composition between said portions of said patterned features that overlap said seed layer.

13. The method of claim 2, wherein said adhesion promoting composition comprises an amino-silane.

14. The method of claim 2, wherein said adhesion promoting composition chemically interacts with a portion of said seed layer, said wet etching step removing said portion of said seed layer from said surface that has chemically interacted with said adhesion promoting composition.

15. A method of electroplating a conductive material onto a surface of a seed layer, said surface seed layer positioned between dielectric features photolithographically patterned into a fully-imidized photosensitive polyimide dielectric composition, the method comprising the steps of:

(a) forming said seed layer so that it is supported on a dielectric substrate comprising silicon;

(b) applying an adhesion promoting composition to said seed layer and said dielectric substrate;

(c) coating said seed layer and said dielectric substrate having said adhesion promoting composition applied thereto, with said fully-imidized photosensitive polyimide, said adhesion promoting composition promoting the adhesion of said polyimide with both said dielectric substrate and said seed layer;

(d) removing a portion of said polyimide such that said surface of said seed layer is uncovered;

(e) plasma etching said surface of said seed layer to remove said adhesion promoting composition applied to said surface of said seed layer;

(f) removing at least several monolayers from said surface of said seed layer; and (g) electroplating said conductive material onto said surface of said seed layer.

16. A method for preventing the formation of distortions in a conductive feature to be electroplated onto a surface of a seed layer, the method comprising the steps of:

(a) plasma etching said surface of said seed layer to remove adhesion promoting composition applied to said surface of said seed layer;

(b) removing at least monolayers of said seed layer from said surface; and (c) electroplating the conductive feature onto said surface.

17. A method for reducing the formation of distortions in a conductive feature to be electroplated onto a surface of a seed layer, the method comprising the steps of:

(a) plasma etching the surface of the seed layer to remove unwanted residue on the surface;

(b) removing at least several monolayers of the seed layer from the surface; and (c) electroplating the conductive feature onto the surface.

18. The method of claim 17, wherein step (b) further comprises:

wet etching the surface of the seed layer to remove at least several monolayers from the surface of the seed layer.

19. The method of claim 17, wherein the plasma etching is selective for said unwanted residue.

20. The method of claim 18, wherein the wet etching is selective for the seed layer.

21. A method for reducing the formation of distortions in a conductive feature to be electroplated onto a surface of a seed layer that has had a metal sacrificial layer applied to it, the method comprising the steps of:

(a) plasma etching the surface of the seed layer to remove the metal sacrificial layer on the surface;

(b) removing at least several monolayers of the seed layer from the surface; and (c) electroplating the conductive feature onto the surface.

22. The method of claim 21, wherein step (b) further comprises:

wet etching the surface of the seed layer to remove at least several monolayers from the surface of the seed layer.

23. The method of claim 21, wherein the plasma etching is selective for the metal sacrificial layer.

24. The method of claim 22, wherein the wet etching is selective for the seed layer.

25. A method for providing a surface of a seed layer onto which a conductive material can be electroplated, the surface of the seed layer positioned between dielectric features photolithographically patterned into a fully-imidized photosensitive polyimide dielectric composition, the method comprising the steps of:

(a) forming the seed layer so that it is supported on a dielectric substrate;

(b) applying a metal sacrificial layer to the seed layer;

(c) applying an adhesion promoting composition to the dielectric substrate and the metal sacrificial layer;

(d) coating the metal sacrifical layer and the dielectric substrate having the adhesion promoting composition applied thereto, with the fully-imidized photosensitive polyimide, the adhesion promoting composition promoting the adhesion of the polyimide with the dielectric substrate and the metal sacrificial layer;

(e) removing a portion of the polyimide such that a surface of the metal sacrificial layer coated with the adhesion promoting composition is uncovered;

(f) plasma etching the surface of the seed layer to remove the adhesion promoting composition and the metal sacrificial layer; and (g) removing at least several monolayers from the surface of the seed layer.

26. The method of claim 25, wherein the plasma etching is selective for the adhesion promoting composition and the metal sacrificial layer.

27. The method of claim 25, wherein step (g) further comprises:

wet etching said surface of said seed layer after said plasma etching step to remove at least several monolayers of said seed layer from said surface.

28. The method of claim 27, wherein said wet etching is selective for the seed layer.

* * * * *

UNITED STATES PATENT AND TRADEMARK OFFICE

CERTIFICATE OF CORRECTION

PATENT NO. : 4,988,413

DATED : January 29, 1991

INVENTOR(S) : K.K. Chakravorty et al.

It is certified that error appears in the above-identified patent and that said Letters Patent is hereby corrected as shown below:

| Column | Line | Error |
|---|---|---|
| 2 | 46 | "had" should be --has-- |
| 3 | 1 | "DISCRIPTION" should be --DESCRIPTION-- |
| 3 | 9 | after "the" insert --present-- |
| 6 | 17 | "well defined" should be --well-defined-- |
| 6 | 23 | "alternations" should be --alterations-- |
| 7 | 27 | "conductors" should be --conductor-- |
| 7 | 48 | "had" should be --has-- |
| 7 | 49 | "above,." should be --above,-- |
| 7 | 58 | "sacrifical" should be --sacrificial-- |
| 8 | 17 | "sacrifical" should be --sacrificial-- |
| 9 | 30 | after "and" delete --the-- |
| 9 | 40, 41 | "PROBIMI-DE™" should be --PROBIMIDE™-- |
| 9 | 61 | "spsin" should be --spin-- |
| 10 | 2 | "paterned" should be --patterned-- |
| 10 | 21 | "silimar" should be --similar-- |
| 11 | 50 | "of" should be --for-- |
| 11 | 51 | after "surface" insert --of--(second occurrence) |
| 12 | 15 | after "least" insert --several-- |
| 13 | 1 | "sacrifical" should be --sacrificial-- |

Signed and Sealed this

Twenty-sixth Day of May, 1992

*Attest:*

*Attesting Officer*

DOUGLAS B. COMER

*Acting Commissioner of Patents and Trademarks*